United States Patent [19]

Marner et al.

[11] 4,225,870

[45] Sep. 30, 1980

[54] NULL STEERING ANTENNA

[75] Inventors: Gene R. Marner, Chesterfield, Mo.; Nathan Marchand, Greenwich, Conn.

[73] Assignee: The United States of America as represented by the Secretary of the Army, Washington, D.C.

[21] Appl. No.: 904,366

[22] Filed: May 10, 1978

[51] Int. Cl.[2] ..... H01Q 3/26

[52] U.S. Cl. ..... 343/854; 343/100 SA

[58] Field of Search ..... 343/854, 754, 100 SA, 343/100 LE, 844, 853

[56] References Cited

U.S. PATENT DOCUMENTS

| | | | |
|---|---|---|---|
| 3,319,249 | 5/1967 | Blachier et al. | 343/854 |
| 3,670,335 | 6/1972 | Hirsch | 343/854 |
| 3,725,929 | 4/1973 | Spanos | 343/854 |
| 3,806,930 | 4/1974 | Gobert | 343/854 |
| 3,877,012 | 4/1975 | Nelson | 343/100 SA |
| 3,964,065 | 6/1976 | Roberts et al. | 343/100 SA |

*Primary Examiner*—David K. Moore

*Attorney, Agent, or Firm*—Nathan Edelberg; Robert P. Gibson; Norman L. Wilson, Jr.

[57] ABSTRACT

Where there is a difference in the angle of arrival between desired incoming signals and interfering signals, the reception of the desired signals is maximized by the creation of nulls in the direction of the interfering signals. A high quality receiving (or transmitting) beam is formed by a one-time calculation of the proper phase or amplitude adjustment required to create a null in the direction of each interfering signal. The antennae are then appropriately adjusted to establish the nulls.

20 Claims, 7 Drawing Figures

NULL STEERING ANTENNA

BACKGROUND OF THE INVENTION

1. Field of the Invention

The invention relates, in general, to the area of art known as null steering and, more particularly, to a method and apparatus for receiving radio signals from a desired source while at the same time reducing the response to interfering signals, if there is a difference in the angle of arrival of the two signals.

2. Description of Prior Art

Highly directive transmission and receiving beams have been developed and are used extensively in the antenna art. One type of directive beam antenna is the well-known "phased array", wherein array elements phase commands are used to scan the beam of a planar phased array. This technique is typified by U.S. Pat. Nos. 3,877,012 to Nelson, 3,806,930 to Gobert, and 3,319,249 to Blachier. Although "phased arrays" use phase adjustments, they do not relate to null steering art contemplated by the present invention.

In addition there have been developments in the area of both simultaneous formation of a null in the pattern of reception and for changing the direction of a null. This technique is usually termed "null steering phased arrays" or "adaptive arrays." Prior patents in this area include U.S. Pat. Nos. 3,670,335 to Hirsch; 3,964,065 to Roberts; and 3,725,929 to Spanos. The creation of pattern nulls in phased antenna arrays require devices for varying phase and amplitude of the signals received from or fed to each antenna of the array. The correct values of signal amplitude and phase relationship to be fed to each antenna are then calculated. By means of attenuators to adjust amplitude and phase shifters to adjust phase, the correct values are obtained. Thus, to create a null in a desired direction, a calculation and an adjustment to the attenuator and phase shifter for each antenna is required.

It is also known to use phase shifters alone and still obtain a pattern null in the desired direction. The adjustments, however, were very complicated. Since no exact solution was available from theory, the phase shifters for each antenna were set at the value obtained from the previous theory of amplitude and phase adjustment. The attenuator device was not needed since the amplitude was not varied. The phase shifter of one antenna was then changed a small amount. If the amplitude of the interfering signal decreased, then the change was deemed proper. If the interference signal increased, the phase shifter was changed in the opposite direction. This trial and error method was then repeated for each antenna of the array. The whole procedure was repeated over and over again until a stable result was obtained. This process, an iterative procedure, requires many rapid calculations which are time consuming unless a relatively high speed computer is available. A high speed accurate phase shifter for each antenna is required along with a highly sophisticated control system. In addition, since decisions have to be made very rapidly for each phase change, the criteria used to evaluate the null depth are very limited.

SUMMARY OF THE INVENTION

It is, therefore, an object of the invention to reduce the response-time of a radio receiver to interfering signals, if there is a difference between the arrival angle of the interfering singals and the desired signal.

Another object of this invention is to provide an improved means for determining the phase or amplitude adjustments required for null steering.

Another object of the invention is to improve on known null steering techniques with regard to speed of calculation, computation simplicity, and the overall rejection of an interfering signal relative to the desired signal.

Briefly, the present invention enhances the conventional directivity characteristics of antennae by creating a null in the arrival direction of the interfering signal while at the same time forming a beam for preferential reception in the direction of the desired signal source. The antenna system is an array of antennae in which phase or amplitude adjustments are made in the signal lines. The lines are added to obtain a composite signal which is then applied to the receiver.

DETAILED DESCRIPTION

Figure 1:
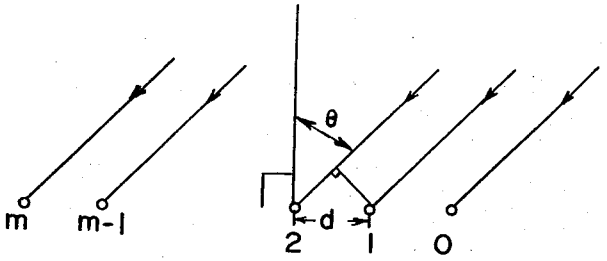
FIG. 1 shows a phased array of antennae spaced along a straight line.

A linear array of antenna elements for the phased array is shown in FIG. 1. It is assumed that the amplitude and phase of the signal from each antenna can be separately adjusted before they are added together in a summing circuit. The antenna array is also assumed to be large, with the element voltages tapered if necessary to reduce side lobes. For large arrays of this type, minor lobes are usually quite small, 20 to 30 db down from the maximum. The following discussion is not limited by the requirement for small minor lobes but their implications are taken into account.

In FIG. 1, a linear phased array of $(m+1)$ antennae 0, 1, . . . m is shown spaced a distance of d electrical radians apart at the frequency of operation. The signal is shown coming in from a direction $\theta$ measured from a reference direction perpendicular to the array as shown at antenna number 2.

Assuming that all antennae are similar, the phase of the signal received by each antenna is assumed dependent only upon the time of arrival relative to the other antennae. Although amplitude variations in received signals may or may not be introduced for minimum side lobes, each voltage is considered separately ($E_n$). The relative signal received by summing the antennas through a phase shifting and summing network is given by $$E_\theta = \sum_{n=0}^{n=m} E_n \cos[\omega t + n(\phi - d \sin\theta)] \quad (1)$$

where d=spacing between antennas in radians of wavelength $\theta$=direction of reception $E_\theta$=total summed signal received from direction $\theta$ $E_n$=signal amplitude transmitted to combining network from $n^{th}$ antenna $\phi$=phase shift introduced into the antenna labeled one spaced d from the reference antenna labeled zero received signal before summing $n\phi$=phase shift introduced into the $n^{th}$ antenna received signal before summing f=signal frequency $\omega=2\pi f$ $E_\theta$ is a maximum, $E_\phi$, when $$\phi = d \sin\theta \quad (2)$$

so that $$E_{\phi'} = \left(\sum_{n=0}^{m} E_n\right) \cos\omega t \quad (3)$$

Thus the angle at which maximum reception occurs is given by $\theta'$ where $$\theta' = \sin^{-1}(\phi/d) \quad (4)$$

Null Formation

The antenna pattern, for any specific value of $\phi$, as given by equation (1), has minor lobes and nulls that naturally exist. Sometimes when heavy interference or noise is coming from a specific direction $\theta^*$ and no null normally exists there, it is desirable to create a deep null in that direction.

For instance, in a direction $\theta^*$ where a side lobe exists $E_\theta$ would have the value $E_\alpha$ at $\theta$ equal to $\theta^*$ namely $$E_\alpha = \sum_{n=0}^{m} E_n \cos[\omega t + n(\phi - d \sin\theta^*)] \quad (5)$$

To create the null, another receiving pattern $E_\theta'$ is created where $$E_\theta' = \sum_{n=0}^{m} KE_n \cos[\omega t + n(\alpha - d \sin\theta)] \quad (6)$$

where $$\alpha = d \sin\theta^* \quad (7)$$

Now at $\theta^*$ $$E_\theta' = \sum_{n=0}^{m} KE_n \cos[\omega t] = E_\alpha \quad (8)$$

Taking K outside the summation sign and substituting from (3)

$$E_\alpha = KE_\theta \quad (9)$$

so that $$K = (E_\alpha/E_\phi) = K\angle\gamma \quad (10)$$

Since, as shown in equation (5), K has both amplitude and phase, it is noted that K consists of an amplitude factor k and a phase factor $\gamma$. Phase relationships have to be maintained.

It is possible to make K real instead of complex by using the center of radiation (or phase center) of the antenna as a reference instead of the edge of the array.

The null at $\theta^*$ is obtained by subtracting $E_\theta'$ from $E_\theta$ $$E_\theta - E_\theta' = \sum_{n=0}^{m} E_n \cos[\omega t + n(\phi - d \sin\theta)] - kE_n \cos[\omega t + \gamma + n(\alpha - d \sin\theta) \quad (11)$$

The phase relationships are better illustrated by adding and subtracting $n\phi$ in the second term and simplifying.

$$E_\theta - E_\theta' = \sum_{n=0}^{m} E_n (\cos[\omega t + n(\phi - d \sin\theta)] - k \cos[\omega t + \gamma + n(\phi - d \sin\theta) - n(\phi - \alpha)]) \quad (12)$$

Each term of the summation (12) is the voltage from a single antenna. In this case, in the $n^{th}$ antenna the received voltage would be divided, one would be delayed by the phase of $n\phi$, the other would be delayed by a phase of $\gamma+n\alpha$ (the $n\phi$ terms cancel out) and attenuated by a factor k. The two voltages would be combined using the difference as shown.

Figure 2:
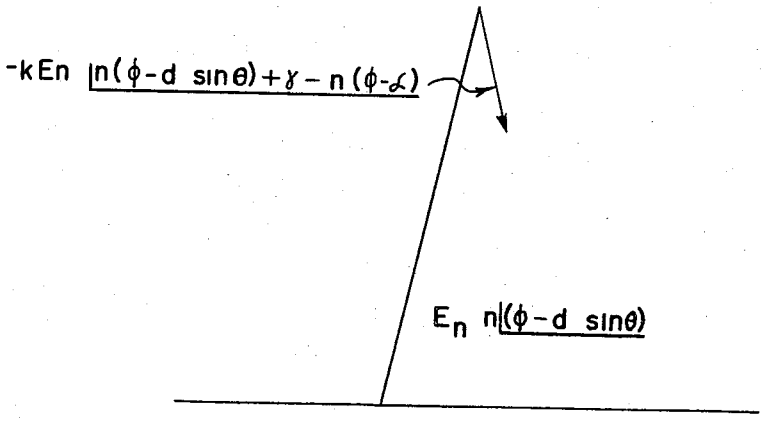
FIG. 2 is a phasor diagram illustrating the constant phase angle between the two components of voltage from the nth antenna.
Figure 3:
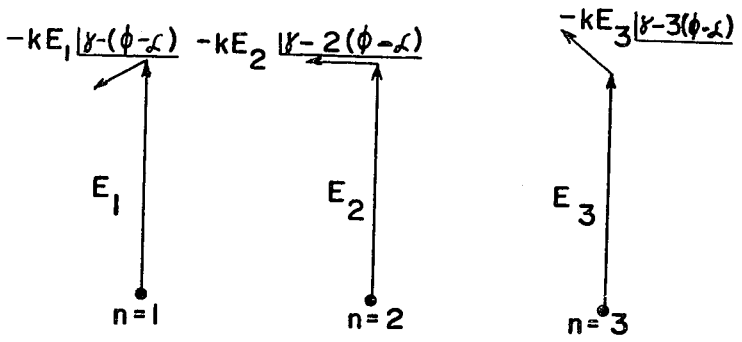
FIG. 3 is a series of phasor diagrams illustrating how the sideband ($kE_n$) varies with respect to $E_n$ as n varies from 0 to 3.

FIG. 2 shows a phasor diagram of the two components of equation (12). As can be seen, the phase angle between the two components is always constant with time- and angle-of-arrival of the signal, namely $\gamma-n(\phi-a)$. The amplitude $kE_n$ is usually quite small but is magnified in the illustration for clarity. In FIG. 2, it can be seen that as n varies, while keeping t constant, the small phasor $(-kE_n)$ will rotate around the end of the main signal $(E_n)$ very much like a single sideband modulating signal. However, its phase is dependent upon n and not upon t or $\theta$. The relationship is shown in FIG. 3 for the first few antennae where the second part of equation (12) (amplitude $kE_n$) varies around $E_n$ with n like a modulating signal. $E_n$ is used as the reference normalized to a fixed amplutude and phase.

Phase-Only Null Steering

Analogous to modulation techniques, null steering is then obtained by adding phase shift only between the signals in the n antennae. Using phase modulation theory, the components of equation (12) shown in FIG. 3 are analogous to the carrier and one of the sidebands of a phase modulated wave. Another component, $E_\theta''$, is analogous to the second of the first pair of sidebands, where $$E_\theta'' = \sum_{n=0}^{m} kE_n \cos[\omega t + n(\phi - d \sin\theta) - \gamma + n(\phi - \alpha)] \quad (13)$$

so that $$E_0 - E_0' + E_\theta'' = \sum_{n=0}^{m} E_n (\cos[\omega t + n(\phi - d \sin\theta)] - \overbrace{k \cos[\omega t + \gamma + n(\phi - d \sin\theta) - n(\phi - \alpha)]}^{A} + \quad (14)$$

-continued $$\overbrace{k\cos[\omega t-\gamma+n(\phi-d\sin\theta)+n(\phi-\alpha)]}^{B}\Big]$$

Figure 4:
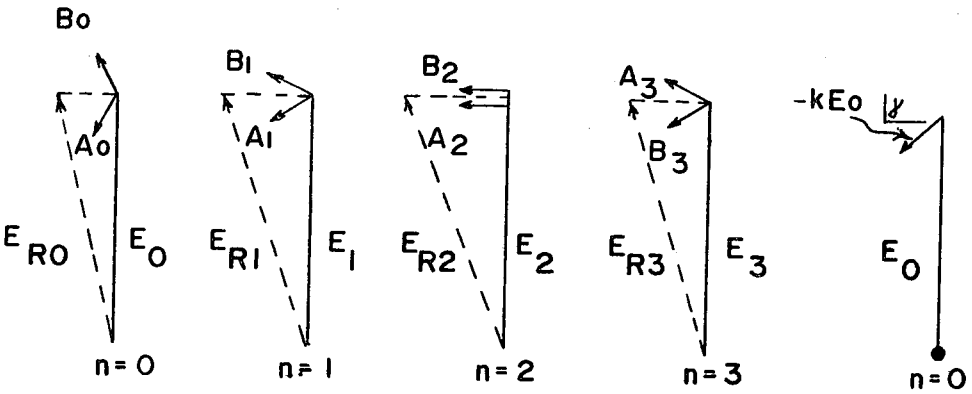
FIG. 4 is a second set of phasor diagrams wherein phase modulation is simulated by the introduction of a new component, B, for values of n from 0 to 3.

This sideband has been chosen so that it completes the first pair of sidebands of an equivalent phase modulated wave. Noting the first component as A and the second (new) component as B, the effect is shown in FIG. 4. Introducing B results in a phase shift from antenna to antenna with only a small change in amplitude. (Actually the change in amplitude is much smaller than shown because the amplitude of A and B have been exaggerated for clarity of illustration. The side lobes are normally over 20 db down so that the magnitudes of A and B would be less than one-tenth $E_n$.)

Using $$-\cos a+\cos b=2\sin\tfrac{1}{2}(a-b)\sin\tfrac{1}{2}(a+b) \tag{15}$$

(14) becomes $$E_{Rn}=E_\theta-E_0'+E_0''=\sum_{n=0}^{m}E_n(\cos[\omega t+n(\phi-d\sin\theta)]+2k\sin[\gamma-n(\phi-\alpha)]\sin[\omega t+n(\phi-d\sin\theta)]) \tag{16}$$

where $E_{Rn}$ is the resultant shown in FIG. 4. Thus the phase shift is determined by $(2k\sin[\gamma-n(\phi-\alpha)])$ which is a constant for each antenna depending upon $\phi,\alpha,\gamma$ and k and does not vary with time- or angle-of-arrival. Thus the additional phase shift for the $n^{th}$ antenna for a null in the direction $\theta^*$ (where the maximum is in the direction $\theta'$) is $B_n$ given by $$\beta_n=\tan^{-1}(2k\sin[\gamma-n(\phi-\alpha)]) \tag{17}$$

This equation for $B_n$ is correct for the added phase shift when k is very small, which is usually the case. A more exact equation is required where k is larger and the derivation thereof follows after the discussion of Amplitude-Only Null Steering.

Equation (16) can be used for the case of small side lobes, however there may still remain a small amount of amplitude modulation as can be seen by the variation in size of $E_{Rn}$, the resultant in FIG. 4. This amplitude modulation can be negated by introducing the equivalent of additional pairs of sidebands, as in phase or frequency modulation. A basic requirement for pure phase modulation is that the amplitudes of the main beam and components be related to one another as Bessel Functions of the first kind to the same argument. Letting Z represent the argument and $J_n$ the Bessel Function, then the resultant $E_R$ is given by $$\begin{aligned}E_R=\sum_{n=0}^{m}E_n(&J_0(Z)\cos[\omega t+n(\phi-d\sin\theta)]+\\&2J_1(Z)\sin[\gamma-n(\phi-\alpha)]\sin[\omega t+n(\phi-d\sin\theta)]+\\&2J_2(Z)\cos[\gamma-2n(\phi-\alpha)]\cos[\omega t+n(\phi-d\sin\theta)]+\\&\ldots)\end{aligned} \tag{18}$$

FIG. 3 can be used to determine the argument (Z). From (16) it can be seen that $$k=\frac{J_1(Z)}{J_0(Z)} \tag{18}$$

Figure 5:
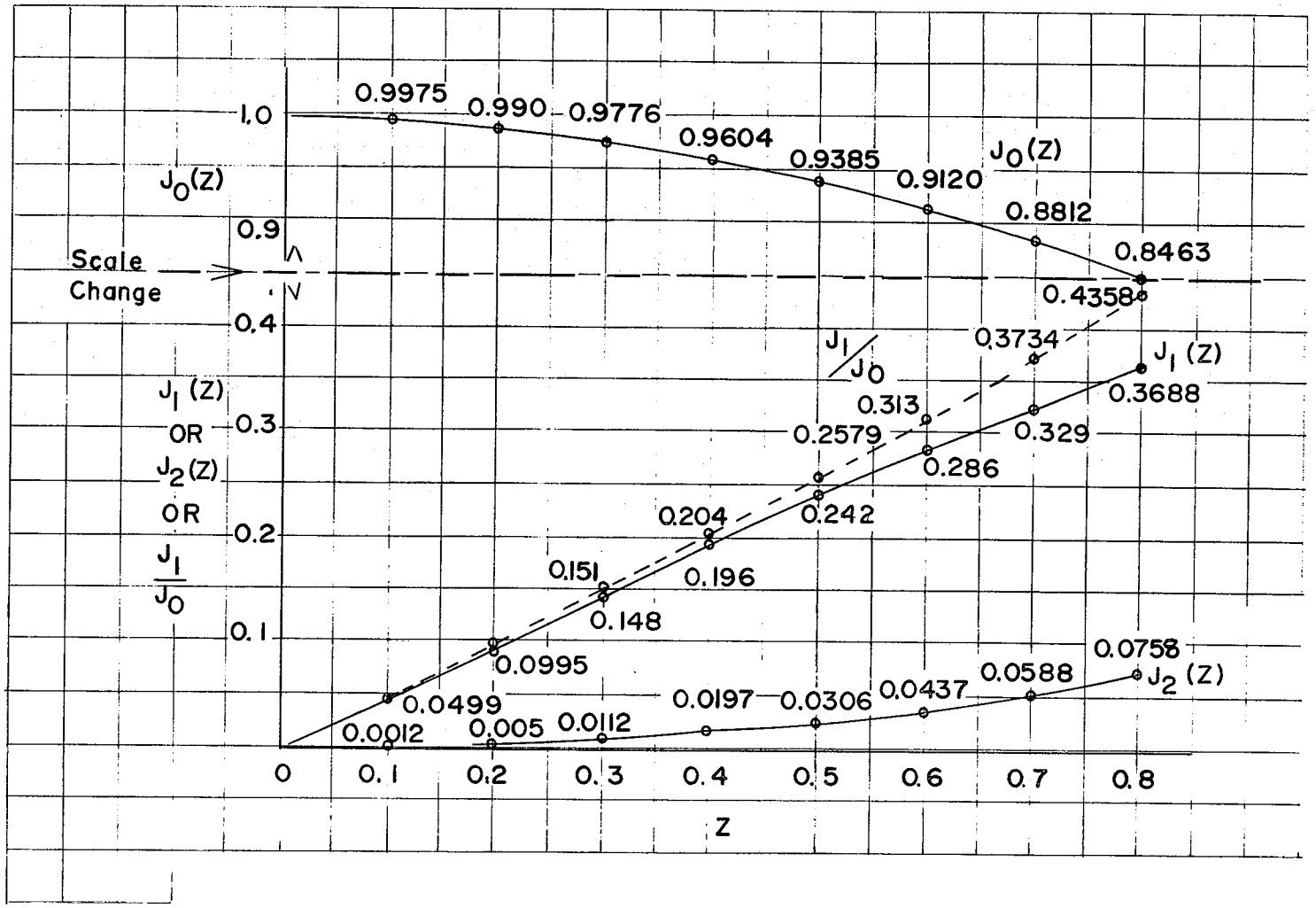
FIG. 5 is a graph of the relative amplitude of Bessel Functions for different arguments.

The ratio of $J_1$ over $J_0$ is plotted in FIG. 5. There is a specific value of Z for every ratio of $J_1$ over $J_0$. For instance, for 20 db down, $J_1$ over $J_0$ is 0.1 and referring to the curve, the approximate value of Z is 0.2. For this argument the value of $J_0(0.2)$ is 0.990, $J_1(0.2)$ is 0.0995, $J_2(0.2)$ is 0.005 and all other terms are negligible. Thus, the amplitude of the main beam will decrease by about one percent, a negligible amount, when the small variation in amplitude is removed by inserting only phase variation.

It will be noted that the only function of the $J_2(Z)$ sidebands, the added harmonics, is to remove the amplitude variation introduced by the first pair of sidebands. For this portion of the discussion the only component that needs to be adjusted to create the desired null is the phase shift introduced by the first pair of sidebands (as in equation 16). Keeping the amplitude constant is equivalent to introducing the added set of sidebands.

The previous calculations result in a very simple method for producing specific new deep nulls in a phased array where the minor lobes are relatively small (about 20 db down from the major lobe maximum). One procedure which can be used is as follows:

- Calculate the progressive phase shift ($\phi$) for the creation of a maximum in the main lobe in the desired direction. This is the progressive phase shift for the main beam voltage E.
- Calculate the amplitude of the minor lobe of the main beam in the direction of the desired null. Determine its phase relative to the main beam voltage $E_\phi$.
- Calculate k, the amplitude ratio of the amplitude of the minor lobe in the direction of the null, to the peak amplitude of the main beam and determine $\gamma$, the phase relationship.
- Determine the progressive phase shift necessary to obtain a maximum lobe peak in the direction of the desired null. This will determine $\alpha$.
- For each antenna, determine the value of $(2k\sin[\gamma-n(\phi-\alpha)])$.
- Taking the arc tangent of the above value will determine the added phase shift for each antenna to obtain a null in the desired direction.

The resultant variation in pattern can be obtained by referring to FIG. 5. The ratio of $J_1$ over $J_0$ is given by k. Thus the value of k on the curve $J_1$ over $J_0$ gives the value of the argument Z. The value of Z determines $J_0(Z)$, $J_1(Z)$ and $J_2(Z)$·$J_0(Z)$ is the factor by which the main beam decreases. Ony $J_1(Z)$ sideband creates a major beam pattern at the desired null point which is just equal and opposite to the minor lobe amplitude at that point. The other sideband creates a maximum to the other side of the main lobe, its actual displacement being dependent upon d $\sin\theta$. The difference in d $\sin\theta$ between the main lobe position and the null position will be the same as the difference between the new maximum and the main lobe. The second set of components, the $J_2$ sidebands, will create two indentations in the pattern at twice the d $\sin\theta$ displacement but their effect will be negligible.

Usually the main beam calculation is well behaved and the characteristics are predictable. However the actual side lobe patterns do not conform perfectly to its mathematical model. They may be distorted by irregularities in spacing, variations in feeder line link length, etc. They are not well behaved. The patterns however can be obtained empirically thereby obtaining the value of k as a function of $\theta$. This value can be used in equation (17) because the new pattern which we wish to superimpose will have a well behaved main beam in the direction in which a null is desired. The foregoing discussion is therefore applicable.

Amplitude-Only Null Steering

It is also possible to create specific new deep nulls in a phased array antenna pattern using only added amplitude variation. Equation (13) is again used, only it is combined with (12) without changing the sign. Thus $$E_0 - E_\theta' - E_\theta'' = \sum_{n=0}^{m} E_n \cos[\omega t + n(\phi - d\sin\theta)] - \overbrace{k\cos[\omega t + n(\phi - d\sin\theta) + \gamma - n(\phi - \alpha)]}^{C} - \overbrace{k\cos[\omega t + n(\phi - d\sin\theta) - \gamma + n(\phi - \alpha)]}^{D} \quad (20)$$

Figure 6:
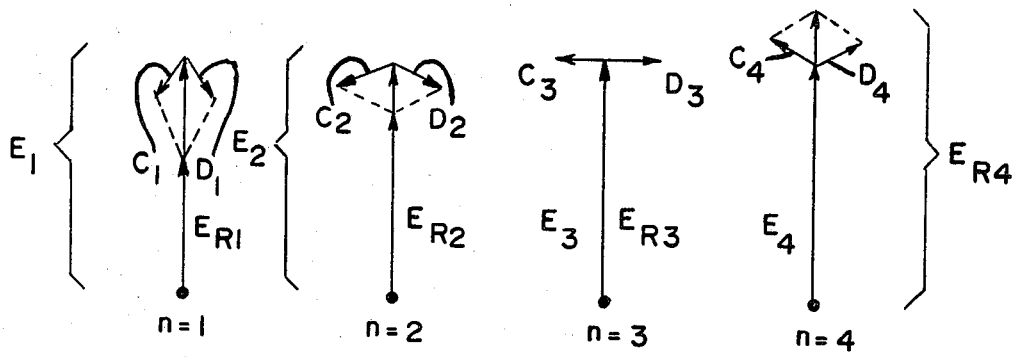
FIG. 6 illustrates the second of the pair of sidebands with the correct amplitude and phase to simulate amplitude modulation varying with n.

Using the relationship of the sum of the two cosines, (20) becomes $$E_\theta - E_\theta' - E_\theta'' = \sum_{n=0}^{n=m} E_n (1 - 2k\cos[\gamma - n(\phi - \alpha)])\cos[\omega t + n(\phi - d\sin\theta)] \quad (21)$$

which is equivalent to the results illustrated in FIG. 6 where only the amplitude of $E_n$ is varied to obtain the null.

Thus, the method required for amplitude-only null steering is as follows:

- Calculate the progressive phase shift ($\phi$) for the creation of a maximum in the main lobe in the desired direction. This is the progressive phase shift for the main beam voltage E.
- Calculate the amplitude of the minor lobe of the main beam in the direction of the desired null. Determine its phase relative to the main beam voltage E.
- Calculate k, the ratio of the voltage of the minor lobe in the direction of the desired null to the peak voltage of the main beam and determine $\gamma$, the phase relationship.
- Determine the progressive phase shift necessary to obtain a maximum lobe peak in the direction of the desired null. This will determine $\alpha$.
- For each antenna determine ($2k\cos[\gamma - n(\phi - \alpha)]$). This determines the amplitude variation to be incorporated into each antenna voltage for creation of the desired null. The phase of $E_n$ is not changed. The resultant phasors will have no added phase variation introduced into them since the added phasor, as shown in FIG. 6, removes any orthogonal component. The added phasor introduces an added null an equal delay angle distance of $d\sin\theta$ equivalent to the $d\sin\theta$ angle distance between the main lobe and the desired null. The added null is at a mirror image point in the pattern taking into account the $\sin\theta$ distortion.

Supplemental Derivation

As mentioned above, equation (17) is only correct for the added phase shift when the amplitude to be nulled is very small (where k is very small). This is normally a valid assumption inasmuch as the steerable nulls are usually created in the side lobes where they are nominally 20 db down from the main lobe. To aid demonstrating when k is small enough to make the above assumption, it is helpful to consider the following derivation. Simplifying (14) by using the center of radiation so that $\gamma$ is zero and letting $$C = \omega t + n(\phi - d\sin\theta)$$

$$D = -n(\phi - \alpha)$$

$$E = E_{74} - E_{74}' + E_{74}'' \quad (22)$$

Then $$E = \sum_{n=0}^{m} E_n [\cos C - k\cos(C + D) + k\cos(C - D)] \quad (23)$$

Expanding the cosines of C+D and C−D $$E = \sum_{n=0}^{m} E_n [\cos C - k\cos C\cos D + k\sin C\sin D + k\cos C\cos D + k\sin C\sin D] \quad (24)$$

and simplifying it becomes $$E = \sum_{n=0}^{m} E_n [\cos C + 2k\sin C\sin D] \quad (25)$$

Consider now the following equation of pure phase variations $$\cos(C - 2K\sin D) = \cos C\cos(2k\sin D) + \sin C\sin(2k\sin D) \quad (26)$$

now $2k$ is very small so that the following assumptions can be made $$\cos(2k\sin D) = 1$$

and $$\sin(2k\sin D) = 2k\sin D$$

(This is true only when $2k\sin D$ is small enough so that its cosine can be considered equal to 1 and its sine could be considered equal to the angle itself.) (26) becomes $$\cos(A - 2k\sin D) = \cos C + 2k\sin C\sin D \quad (27)$$

when (27) is substituted into (25)

$$E = \sum_{n=0}^{m} E_n \cos(C - 2k\sin D) \quad (28)$$

Thus the above assumptions give the required result; each voltage in each of the antennas is constant in voltage and only incorporates an added phase shift.

When k is too large to make the assumption necessary for equation (17), amplitude variation would result unless added sets of signals are introduced. Equation (18) is derived as follows for the case of larger values of k. Since the simplification cannot be introduced in (26), the function is expanded into a Bessel Function series. Thus using the relationships for Bessel functions $$\cos(u\sin D) = J_0(u) + 2\sum_{l=1}^{\infty} J_{2l}(u)\cos 2lD$$

$$\sin(u\sin D) = 2\sum_{l=1}^{\infty} J_{2l-1}(u)\sin(2l - 1)D \quad (29)$$

gives for the phase modulated wave of (26)

$$\cos(C - u \sin D) = J_0(u) \cos C + 2 \sum_{l=1}^{\infty} J_{2l}(u) \cos(2lD) \cos C + 2 \sum_{l=1}^{\infty} J_{2l-1}(u) \sin(2l-1)D \sin C \quad (30)$$

but $$\cos(2lD) \cos D = \tfrac{1}{2}[\cos(C+2lD) + \cos(C-l2D)]$$

and $$\sin(2l-1)B \sin A = \tfrac{1}{2}[\cos(C+[2l-1]D) - \cos(C-[2l-1]D)] \quad (31)$$

so that (30) becomes $$\cos(C-u \sin D) = J_0(u) \cos C + J_1(u)[\cos(C+D) - \cos(C-D)] + J_2(u)[\cos(C+2D) + \cos(C-2D)] + J_3(u)[\cos(C+3D) - \cos(C-3D)] + \ldots \quad (32)$$

Comparing (32) with the equation for $E_1$, equation (23), it can be seen that the first two terms (the $J_0$ and $J_1$ terms) are the same type as the terms inside the brackets of (23), and k would now be equal to $J_1(u)/J_0(u)$ similar to equation (19). However, there are added terms which have to be introduced in order to avoid any amplitude variation. These are the $J_2(u)$ and $J_3(u)$ terms in equation (32). For the values referred to above, the higher order terms could be neglected.

Using the relationships $$\cos(C+D) - \cos(C-D) = 2 \sin C \sin D$$
$$\cos(C+D) + \cos(C-D) = 2 \cos C \cos D \quad (33)$$

equation (32) becomes $$\cos(C-u \sin D) = J_0(u) \cos C + 2J_1(u) \sin C \sin D + 2J_2(u) \cos C \cos 2D + 2J_3(u) \sin C \sin 3D + \ldots \quad (34)$$

which is the equation (18) for $E_R$ using the center of radiation so that k is real making $\gamma$ zero.

Specific Application

Figure 7:
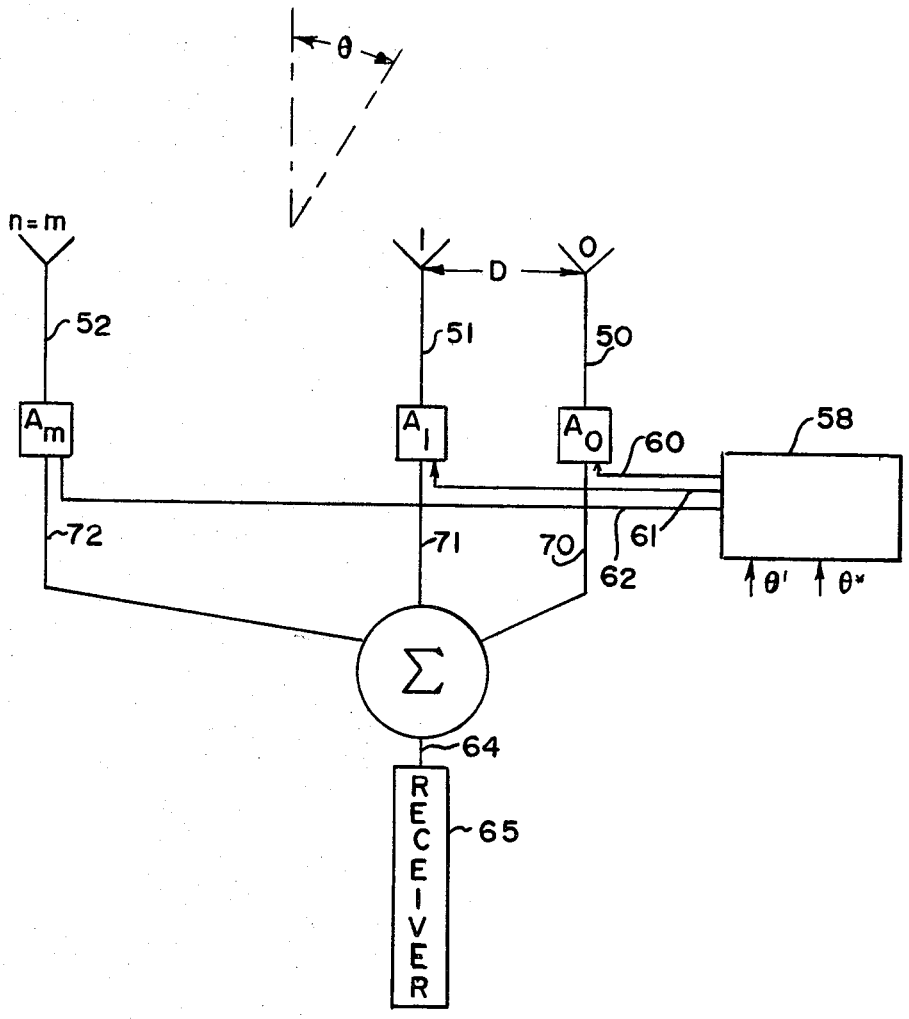
FIG. 7 is a schematic diagram of an antenna array constructed in accordance with the principles of the present invention.

A linear array of m+1 antennae 0, 1, . . . m is shown in FIG. 7, each antenna output on lines 50, 51, 52, etc being connected to a device $A_n$ (n=0, 1, . . . m), which is capable of phase and/or amplitude adjustment of its respective antenna output signal. For clarity in description the array will be considered as planar with one-dimensional adjustments (forming fan beams rather than pencil beams), the signals will be considered as fixed, single frequencies, and a single interfering source will be considered. Computer 58 feeds command signals via lines 60, 61, 62 etc. to phase or amplitude adjusters $A_0$, $A_1$, . . . $A_m$ thereby adjusting the phase or amplitude signal from the antennae. Computer 58 is a general purpose digital computer such as the Varian V-73, the DEC PDP-11/45 or the interdata Mod 85 if there are many antenna elements and rapid adaptation is desired.

The characteristics of computer 58 can be determined from requirements discussed and the performance characteristics desired. The signal lines 60, 61, 62, etc from computer 58 to the adjuster $A_o$–$A_m$ may carry either digital or analog signals depending upon the type of circuit desired. In addition to the data stored in the computer memory, inputs to computer 58 are required specifying the directions of the desired signal, $\theta'$, and the undesired signal, $\theta^*$. In FIG. 7, arbitrarily selected values $\theta'$ and $\theta^*$ are referenced into computer but it should be apparent that a feedback or tracking circuit could be used to provide command signals to computer 58. The antenna signals, as modified by adjusters $A_o$–$A_m$, are fed via lines 70, 71, 72 etc to a summing junction and, from there via line 64 to radio receiver 65. The summing junction and/or antenna lines can also add fixed amounts of phase and amplitude, if desired, in order to establish the symmetry center of the array and to achieve desired sidelobe characteristics. The electrical length of the lines are assumed to be equal.

i. Phase-Only

A null can be formed in the direction $\theta^*$ while a mainbeam is formed in the direction $\theta'$ by pure phase adjustments. In this case, the adjusters $A_o$–$A_m$ are phase shifters which add pure phase shifts, $B_n$, $B_n$ being computed according to equation (17) for the nth device and nth antenna:

$$B_n = \tan^{-1}(2k \sin\gamma - n(\phi - \alpha)) \quad (17)$$

Here $n\phi$ is the phase shift which would be required in the nth antenna lead in order to form a beam in the direction $\theta'$ from the normal to the array. $\phi$ is determined by inverse of equation (4), $$\phi = d \sin\theta' \quad \text{(4) INVERSE}$$

d being the spacing between antennas, measured in wavelengths ($d = D/\lambda$). The quantities $n\alpha$ are the phase shifts which would be needed to form a beam in the direction $\theta^*$ where $\alpha = d \sin\theta^*$. $\gamma$ is the phase and k is the amplitude of the antenna signal which would be experienced in the direction $\theta^*$ if a main beam were formed in the direction $\theta$ and no null were formed. Both $\gamma$ and k are measured relative to the center of the main beam. These can be calculated from the general expression, (1), for the amplitude of the summer output 64 as a function of angle of arrival:

$$E_\theta = \sum_{n=0}^{m} E_n \cos[\omega t + n(\phi - d \sin\theta)] \quad (1)$$

Thus, determining the mean beam position to be $\theta = \theta'$ by setting $\phi = d \sin\theta'$.

$$k = \left| \frac{E_{\theta=\theta^*}}{E_{\theta=\theta'}} \right| = \left| \frac{\sum_{n=0}^{m} E_n \cos[\omega t + nd(\sin\theta' - \sin\theta^*)]}{\sum_{n=0}^{m} E_n} \right| \quad (35)$$

The corresponding phase angle is $\gamma$. This not only forms a perfect null by pure phase adjustment only, but also the desired main beam amplitude is essentially unaffected by the formation of this null. However, when the desired null is quite close to the main beam there will be some deterioration in the main beam. This can also be avoided by using the more complicated expression given in the supplemental derivation.

Thus it is possible, in the ideal case, to form a good null and a good beam directly by a single sequence of computations without going through an iterative process of phase adjustment, measurement of results and further adjustment. The advantages over the present Phase-Only Null Steering Systems are significant. For example, when using an iterative type procedure in typical high performance systems, it is found necessary to perform 100–200 iterative adjustments in order to establish good null-beam combinations. Regardless of computation speed, a minimum amount of time is needed for each iteration so that the receiver output can be analyzed to determine if the iterative adjustment has made an improvement or a degradation. If this analysis is performed by minimizing the output power in cases in which the output power is dominated by undersired signal, the process may be carried out rather rapidly, but the composite signal (receiver output) will be dominated by the undersired signal. If an attempt is made to improve the output quality by identifying some feature in the desired signal and performing successive iterations to maximize the desired signal, subject to minimizing the total signal or the undersired signal, the measurement time per iteration will normally be relatively long. With any of these iterative approaches based on quasi-emperical or random phase adjustments the following undesirable conditions may be experienced:

A large number of iterations is required.

A considerable amount of computation is required.

A significant amount of time must be spent during the adjustment process.

Signal quality during the adjustment process is poorer than that attainable when the null and beam have reached their optimum adjustment.

There is a significant limitation on the angle of arrival rates which can be accommodated.

If either angle of arrival is changing, poor signal quality during the adjustment process causes a deterioration in the desired/undesired signal ratio.

As can be seen from comparing the two methods, the novel method proposed here of direct calculation of the values of phase shift necessary for creation of the nulls and their direct implementation not only minimizes computer time and increases speed, but will directly lead to increase in signal-to-noise ratio for the received desired signal.

ii. Amplitude-Only

It is also possible to create nulls by pure amplitude adjustment within the adjusters $A_o$–$A_m$ of FIG. 7. In this case, the adjusters $A_o$–$A_m$ would be amplitude adjusters, such as power dividers or attenuators. In some circumstances an adaptive array utilizing only amplitude adjustments is preferable. For instance, the attenuating circuitry may be simpler and more economical to implement. Also, the superposition of additional patterns to create a null also creates a spurious null which is desirable. Further, the requisite computations are simpler. Equation (21) shows that a multiplicative adjustment of the antenna outputs by the factor $$1-2k\cos[\gamma-n(\phi-\alpha)] \tag{36}$$

will create the desired null. This process is additive, so an additional null can be formed by adding a third term to expression (36) of the same form as the second, with the parameters k and $\phi$ chosen to create the desired null. This can be extended to additional nulls. Steering of the main beam is accomplished by phase adjustments in the amount $$n(\phi-d\sin\theta') \tag{37}$$

as in the phase array case.

iii. Other embodiments

The null steering antenna concept can be extended in several ways. First, the antenna array can be two dimensional, forming a pencil beam and a pencil null rather than a fan beam and a fan null. This can be accomplished by adding additional antenna elements with accompanying phase shifters/attenuators in the orthognal direction, applying the one dimensional discussion independently in each dimension and thereby deriving composite phase shifts and/or amplitude adjustments by combining the values required for each.

Secondly, use of the antenna array can be extended to include separate sets of feeder lines, phase shifters and/or attenuators and summers, as well as computer output lines, to serve separate receivers, thereby establishing multiple sets of beams and nulls, independently serving separate receivers. A matched power divider is required at the output of each antenna element so that the output of that element can serve additional receivers.

Third, in each single set of beam/null forming circuitry serving each receiver, it is possible to form and steer more than one null. To a first approximation, this can be accomplished by applying equation (17) or equation (21), as appropriate, for each null desired. In the case of pure phase adjustment, creation of the first null causes a small spurious beam for reception on the other side of the main beam. Normally, this will not be troublesome. If the angle of arrival of a second interferring signal should occur in this special direction, it is not possible to create a second null in that direction without interfering with the first null. However, this problem can be solved by moving the main beam slightly, thereby changing the location of the spurious beam. But, with this one possible exception, multiple nulls can be added by successive superposition of additional pairs of patterns by using equation (17) where the value of k must take into account the pattern already established in the creation of the earlier nulls. Unless the nulls are closely spaced, the value of k at the location of each additional null will be unaffected by the superposition of the prior nulls.

The formation of the first null by amplitude adjustment according to equation (36) causes a spurious zero value to be added on the other side of the main beam. Since this does not affect the original pattern, it does not cause additional response to an interfering signal. Further, an additional null can be developed by superimposing an additional pair of patterns, using equation (36) for each null.

Fourth, the discussion up to the present point has assumed that the desired signal and the interfering signal were at the same, fixed, single frequency. The analysis, of course, is applicable to any frequency. It should be noted that the spacing between antennas in wavelengths, the sidelobe to main beam ratio k, and the phase shifts $\gamma$, $\phi$ and $\alpha$ are all functions of frequency. Use of normal engineering practices will result in the specification of the signal bandwith and/or the frequency difference which can be tolerated between the signal and the unwanted interfering signal. Of course, if the frequency difference is large, the receiver selectivity and other bandwidth limiting components of the system will provide some rejection of the signal as the quality of the null deteriorates due to the frequency difference.

In the case of a strong broadband interfering signal which overlaps the acceptance bandwidth of the receiver, it is possible to generate a wideband null by forming multiple nulls at slightly different positions which provides the proper dispersive characteristics. This is done by repetitive application of equation (17), calculating a subsequent value of k for the composite pattern which would be formed with the first null at the desired position of the second null, etc. The incremental angle between adjacent nulls would be selected by several engineering considerations, but for maximum performance it should be somewhat smaller than the angular spacing between adjacent sidelobe minima in the original array pattern.

Finally, although the foregoing discussion was directed to a radio receiving system, the same principles apply to a transmitting system, particularly when it is desired to transmit in a specific direction or to avoid transmitting in certain other directions. The apparatus would be similar except that the receiver 65 is replaced by a transmitter, the summer is replaced by a power divider, and all components are designed to handle the high power involved. The pure phase shift control method is especially advantageous relative to current practice since power dissipating attenuators, which are conventionally used to control amplitude, would not be necessary. Very high power efficiency is thereby achieved.

Thus, an antenna array has been described which creates nulls in a desired direction by the use of phase variation, or amplitude variation. No longer is it necessary to vary the phase or amplitude of an antenna by a small amount and then iteratively continue making small adjustments until the correct value is obtained. A method and apparatus has been set forth which permits more rapid adjustment and less complex equipment than has heretofore been known. The variations and modifications will be apparent to those skilled in the art, with the true spirit and scope of the invention being limited only by the following claims.

What is claimed is:

1. In an antenna system of n antenna wherein a desired signal arrives in the general direction of main receiving beam and an undesired signal arrives in a direction at least slightly different from the direction of said desired signal; said main receiving beam having a main lobe in the direction of said desired signal and a minor lobe in the direction of said undesired signal, a method for generating a high quality beam in the direction of said desired signal and a null in the direction of said undesired signal comprising the steps of: calculating the progressive phase shift ($\phi$) necessary to create a maximum in said main lobe;

calculating the progressive phase shift ($\alpha$) required to create a maximum in said minor lobe;

determining the phase of said minor lobe relative to the voltage of said main beam;

determining the amplitude of said minor lobe;

calculating the ratio (k) of the amplitude of said minor lobe relative to the peak amplitude of said main beam;

calculating the phase relationship ($\gamma$) between said minor lobe and said main beam at peak amplitude;

calculating the value of $2\ k \sin [\gamma - n(\phi - \alpha)]$ for each of said n antennae; computing the arc tangent of each said value thereby determining the required phase shift for each antenna; and adding each said required phase shift to the corresponding antenna thereby establishing said null and said high quality beam.

2. In an antenna system of n antennae wherein a desired signal arrives in the general direction of a main receiving beam and an undesired signal arrives in a direction at least slightly different from the direction of said desired signal; said main receiving beam having a main lobe in the direction of said desired signal and a minor lobe in the direction of said undesired signal, a method for generating a high quality beam in the direction of said desired signal and a null in the direction of said undesired signal, comprising the steps of:

calculating the progressive phase shift ($\phi$) necessary to create a maximum in said main lobe;

calculating the progressive phase shift ($\alpha$) required to create a maximum in said minor lobe;

determining the phase of said minor lobe, relative to the voltage of said main beam;

determining the amplitude of said minor lobe;

calculating the ratio (k) of the amplitude of said minor lobe relative to the peak amplitude of said main beam;

calculating the phase relationship ($\gamma$) between said minor lobe and said main beam at peak amplitude;

calculating the value of $2\ k \cos [\gamma\text{-}n(\phi - \alpha)]$ for each of n antennae thereby determining its required amplitude variation; and adding each said required amplitude variation to the corresponding antenna thereby establishing said null and said high quality beam.

3. In an antenna system of n antenna wherein a desired signal arrives in the general direction of a main beam and undesired signals arrive in a direction at least slightly different from the direction of said desired signal; said main beam having a main lobe in the direction of said desired signal and a minor lobe in the direction of each said undesired signal, a method for generating a high quality beam in the direction of said desired signal and a null in the direction of each undesired signal comprising the steps of:

calculating the progressive phase shift ($\phi$) necessary to create a maximum in said main lobe;

calculating all progressive phase shifts ($\alpha$) required to create a maximum in each minor lobe;

determining the phase of each minor lobe relative to the voltage of said main beam;

determining the amplitude of each minor lobe;

calculating all ratios (k) of the amplitude of each minor lobe relative to the peak amplitude of said main beam;

calculating all phase relationships ($\gamma$) between each minor lobe and said main beam at peak amplitude;

for each null, repeatively follow the steps of calculating the value of $2\ k \sin [\gamma\text{-}n(\phi - \alpha)]$ for each of said antenna and with each calculation of said value taking into account the adjustments made in establishing any previous nulls; computing the arc tangent of each said value thereby determining the required phase shift for each antenna; and adding each required phase shift to the corresponding antenna thereby establishing a null in the direction of one of said undesired signals.

4. In an antenna system of n antennae wherein a desired signal arrives in the general direction of a main beam and an undesired signal arrives in a direction at least slightly different from the direction of said desired signal; said main beam having a main lobe in the direction of said desired signal and a minor lobe in the direction of each said undesired signal, a method for generating a high quality beam in the direction of said desired signal and a null in the direction of each undesired signal comprising the steps of:

calculating the progressive phase shift ($\phi$) necessary to create a maximum in said main lobe;

calculating all progressive phase shifts ($\alpha$) required to create a maximum in each minor lobe;

determining the phase of each minor lobe relative to the voltage of said main beam;

determining the amplitude of each minor lobe;

calculating all ratios (k) of the amplitude of each minor lobe relative to the peak amplitude of said main beam;

calculating all phase relationships ($\gamma$) between each minor lobe and said main beam at peak amplitude;

for each null, repetively follow the steps of calculating the value of 2 k cos $[\gamma-n(\phi-\alpha)]$ for each of n antennae, with each value calculation taking into account the adjustments made in establishing any previous nulls; adding each said value calculated to the corresponding antenna thereby establishing a null in the direction of one of said undesired signals.

5. The method of claim 1 wherein $\phi$ is calculated from the equation $\phi=d \sin \theta'$, d being the distance in radians between antennae, with $\theta'$ being the angle of arrival of the desired signal.

6. The method of claim 1 wherein $\alpha$ is calculated from the equation $\alpha=d \sin \theta^*$, d being the distance in radians between antennae, with $\theta^*$ being the angle of arrival of the undesired signal.

7. The method of claim 2 wherein $\phi$ is calculated from the equation $\phi=d \sin \theta'$, d being the distance in radians between antennae, with $\theta'$ being the angle of arrival of the desired signal.

8. The method of claim 2 wherein $\alpha$ is calculated from the equation $\alpha=d \sin \theta^*$, d being the distance in radians between antennae, with $\theta^*$ being the angle of arrival of the undesired signal.

9. The method of claim 3 wherein $\phi$ is calculated from the equation $\phi=d \sin \phi'$, d being the distance in radians between antennae, with $\theta'$ being the angle of arrival of the desired signal.

10. The method of claim 3 wherein $\alpha$ is calculated from the equation $\alpha=d \sin \theta^*$, d being the distance in radian between antennae, with $\theta^*$ being the angle of arrival of the undesired signal.

11. The method of claim 4 wherein $\phi$ is calculated from the equation $\phi=d \sin \theta'$, d being the distance in radians between antennae, with $\theta'$ being the angle of arrival of the desired signal.

12. The method of claim 4 wherein $\alpha$ is calculated from the equation $\alpha=d \sin \theta^*$, d being the distance in radians between antennae, with $\theta^*$ being the angle of arrival of the undesired signal.

13. A null steering antenna for creating a main receiving beam in the direction of a desired signal and a null in the direction of each undesired signal comprising:

(a) an array of antennae positioned in the signal field;

(b) null determining means for computing the phase shift value of the arc tangent of 2 k sin $[\gamma-n(\phi-\alpha)]$ which is required to create each null;

(c) adjustment means responsive to said null determining means for adjusting the phase of each antenna;

(d) summing means to add the adjusted signals from said antennae; and (e) receiver means connected to the output of said summing means which thereby experiences a highly directional reception pattern that is receptive to signals arriving from the direction of said desired signal and virtually nonreceptive to signals arriving in the direction of said nulls.

14. The null steering antenna of claim 13 wherein said null determining means includes means for producing a primary antenna pattern in the direction of said desired signal, and secondary patterns superimposed on said primary pattern, the total number of secondary patterns corresponding to the number of nulls required.

15. The null steering antenna of claim 14 wherein each secondary pattern has one or more pairs of components, one component of each pair being on each side of said main receiving beam, the component of each pair on the side closest to said undesired signal having magnitude and phase chosen to combine with said primary pattern and any previous superimposed pattern to nullify said undesired signal, the component of each pair distant from said undesired signal having magnitude and phase chosen to eliminate the amplitude variations between antenna outputs.

16. A null steering antenna for creating a main receiving beam in the direction of a desired signal and a null in the direction of each undesired signal comprising (a) an array of antennae positioned in the signal field;

(b) null determining means for computing the amplitude variation value of 2 k cos $[\gamma-n(\phi-\alpha)]$ which is required to create each null;

(c) adjustment means responsive to said null determining means for adjusting the amplitude of each antenna;

(d) summing means to add the adjusted signals from said antennae; and (e) receiver means connected to the output of said summing means which thereby experiences a highly directional reception pattern that is receptive to signals arriving from the direction of said desired signal and virtually non-receptive to signals arriving in the direction of said nulls.

17. The null steering antenna of claim 16 wherein said null determining means includes means for producing a primary antenna pattern in the direction of said desired signal and secondary antenna patterns superimposed on said primary pattern, the total number of secondary patterns corresponding to the number of nulls required.

18. The null steering antenna of claim 17 wherein each secondary pattern has one or more pairs of components, one component of each pair being on each side of said main receiving beam, the component of each pair on the side closest to said undesired signal having magnitude and phase chosen to combine with said primary pattern and any previous superimposed pattern to nullify said undesired signal, the component of each pair distant from said undesired signal having magnitude and phase chosen to eliminate the phase variation between antenna outputs.

19. The null steering of claim 14 wherein said means for producing said primary antenna pattern includes means for determining the progressive phase shift required to create a beam maximum in the desired signal direction.

20. The null steering antenna of claim 17 wherein said means for producing said primary antenna pattern includes means for determining the progressive phase shift required to create a beam maximum in the desired signal direction.

* * * * *